US010097935B2

(12) United States Patent
Mauler et al.

(10) Patent No.: US 10,097,935 B2
(45) Date of Patent: Oct. 9, 2018

(54) METHOD FOR PHYSICALLY ADJUSTING A HEARING DEVICE, HEARING DEVICE AND HEARING DEVICE SYSTEM

(71) Applicant: SIVANTOS PTE. LTD., Singapore (SG)

(72) Inventors: Dirk Mauler, Buckenhof (DE); Luis Ignacio Martinez Azkorra, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/480,613

(22) Filed: Apr. 6, 2017

(65) Prior Publication Data

US 2017/0295442 A1 Oct. 12, 2017

(30) Foreign Application Priority Data

Apr. 6, 2016 (DE) ..... 10 2016 205 728

(51) Int. Cl.
*H04R 25/00* (2006.01)

(52) U.S. Cl.
CPC ..... *H04R 25/65* (2013.01); *H04R 25/30* (2013.01); *H04R 25/405* (2013.01); *H04R 25/604* (2013.01); *H04R 2225/021* (2013.01)

(58) Field of Classification Search
CPC ..... H04R 25/30; H04R 25/65; H04R 25/405; H04R 25/604; H04R 2225/021
See application file for complete search history.

(56) References Cited

U.S. PATENT DOCUMENTS

| | | | | |
|---|---|---|---|---|
| 7,139,404 | B2 * | 11/2006 | Feeley | H04R 25/608 381/330 |
| 9,596,551 | B2 * | 3/2017 | Pedersen | H04R 1/1041 |
| 2016/0057547 | A1 | 2/2016 | Buerger et al. | |

FOREIGN PATENT DOCUMENTS

| | | | |
|---|---|---|---|
| DE | 102005006660 | B3 | 11/2006 |
| DE | 102007005861 | B3 | 8/2008 |
| EP | 2908549 | A1 | 8/2015 |

* cited by examiner

*Primary Examiner* — Brian Ensey
(74) *Attorney, Agent, or Firm* — Laurence A. Greenberg; Werner H. Stemer; Ralph E. Locher

(57) ABSTRACT

A hearing device is physically adjusted to suit a hearing device wearer. A position sensor of the hearing device is used to ascertain a characteristic measure of a current actual wearing position of the hearing device. The characteristic measure of the actual wearing position is then taken as a basis for ascertaining a discrepancy between the actual wearing position and a prescribed desired wearing position. On the basis of this discrepancy, an instruction is output to the hearing device wearer to adjust the receiver connector based on the ascertained discrepancy.

15 Claims, 3 Drawing Sheets

METHOD FOR PHYSICALLY ADJUSTING A HEARING DEVICE, HEARING DEVICE AND HEARING DEVICE SYSTEM

CROSS-REFERENCE TO RELATED APPLICATION

This application claims the priority, under 35 U.S.C. § 119, of German patent application DE 10 2016 205 728.6, filed Apr. 6, 2016; the prior application is herewith incorporated by reference in its entirety.

BACKGROUND OF THE INVENTION

Field of the Invention

The invention relates to a method for physically adjusting a hearing device. The invention relates furthermore to a hearing device. Moreover, the invention relates to a hearing device system.

The term "hearing device" is understood to mean particularly hearing aids that are used by persons with a hearing loss to, at least partially, compensate for the hearing loss. To this end, such hearing aids usually comprise at least one microphone for capturing (air-borne) sound—i.e. particularly sounds such as voices, music and other background noise, for example—and for converting the captured sound into electrical signals (subsequently: sound signals or microphone signals). Furthermore, hearing aids usually comprise a signal processing unit (also referred to as a signal processor) that is used to analyze the microphone signals, in most cases for spurious signal components (for example noise, undesirable background noise and the like), to attenuate such spurious signal components and to boost other signal components (in particular desirable "useful signal components"). The (output) signals resulting from this signal processing are subsequently output by a loudspeaker (also referred to as a "receiver") to an ear of the hearing device wearer (i.e. the person with hearing loss) in audible form. As an alternative to the loudspeaker, hearing aids also use—depending on the type of hearing loss—bone conduction implants or cochlear implants for outputting the output signals by means of mechanical or electrical stimulation of the auditory center of the hearing device wearer. However, the term hearing device also covers other devices that are used for (audible) sound output to the ear of the hearing device wearer, such as tinnitus maskers, headphones, headsets or the like, for example.

Hearing aids of the type described above may be set up for monaural or binaural care of the hearing device wearer. In both cases, the hearing device (or both hearing devices) may also have an associated control module, which is separate from the, or the respective, hearing device, in the form of a remote control or in the form of a smartphone with control software installed thereon. In this case, such a control module is used for adjusting the volume and also possibly different hearing programs, for example. Further, the signal processing unit may also have been relocated to such a control module.

Modern hearing devices, particularly hearing aids, are frequently set up (in terms of circuitry or programming) to produce a directivity in order to improve the intelligibility of desirable sounds (i.e. desirable useful signal components of the captured sound signals), for example of voices (speech) and/or music. To this end, the respective microphone signals from two microphones are usually mixed with one another. Producing the directivity creates particularly a direction-dependent sensitivity for the microphones. That is to say that the microphones have at least one preferred direction, so that sound signals that are captured by the microphones from this preferred direction have a higher power than sound signals captured from other directions. Conversely, as appropriate, the sound signals captured by the microphones from outside the preferred direction are attenuated in comparison with the sound signals captured in the preferred direction. This means that the intelligibility of the sounds arriving in the preferred direction—and therefore the sound source emitting the applicable sounds—is regularly increased.

To produce the directivity, it is usually expedient to know the arrangement of the two microphones in relation to one another, particularly the (physical or geometric) spacing thereof. This spacing, when projected onto the direction from which the desirable sound signals arrive at the microphones, represents what is known as an "effective" spacing. In this case, the effective spacing is a measure of the (audible or temporal) delay with which the desirable sound signals arrive at the two microphones. This delay, or this effective spacing, is in most cases taken into consideration when producing the directivity.

In what is known as a polar diagram, which essentially depicts a section in the plane of the preferred direction (subsequently also referred to as "directional plane"), the directivity, i.e. the direction-dependent sensitivity, has the shape of a "cardioid", of a "supercardioid" or of a "hypercardioid", for example. In order to save computation complexity for the analysis of the sound signals on detection thereof, the directivity of a hearing device is in most cases preset on the assumption that the desirable sounds (useful components of the sound signals)—for example the voice of an interlocutor—arrive at the microphones of the hearing device (or of the hearing devices) frontally in relation to the face of the hearing device wearer and in this case, given a neutral, straight head posture, approximately along a horizontal plane that is arranged approximately at the level of the ears of the hearing device wearer. This direction is in the following also referred to as the frontal direction. In this case, the effective spacing of the two microphones is thus the spacing projected onto the frontal direction or the horizontal plane.

For the purpose of presetting the directivity, one variant involves the microphones being arranged geometrically in relation to one another such that the effective spacing and the physical spacing coincide. In other words, for a wearing position as intended, the microphones are arranged along a microphone axis that coincides with the "frontal direction". Alternatively, with a different arrangement of the microphones, the directivity is set by means of a directional parameter such that the direction of the effective spacing is made congruent with the frontal direction. The directivity is (in both cases) usually preset with regard to an idealized model (a "dummy") based on average facial and oracular shapes. During daily use of the hearing device system, the wearing position of the respective hearing device, as idealized on the basis of the model and used for presetting, can differ from the actual wearing position on the head of the hearing device wearer, however, for example on account of the geometrical properties of the hearing device itself and on account of a different anatomical shape of the ear of the hearing device wearer. This can impair the quality of the sound signals captured using the directivity, particularly speech intelligibility and hence use comfort.

SUMMARY OF THE INVENTION

It is accordingly an object of the invention to provide a method and a hearing device which overcomes the abovementioned and other disadvantages of the heretofore-known devices and methods of this general type and provides for a hearing device system having improved use comfort.

With the foregoing and other objects in view there is provided, in accordance with the invention, a method for physically adjusting a hearing device to suit a hearing device wearer, wherein the hearing device has a hearing device body and a receiver connector couplable or coupled to the hearing device body. The method comprises:

using a position sensor of the hearing device to ascertain a characteristic measure of a current actual wearing position of the hearing device;

taking the characteristic measure of the actual wearing position as a basis for ascertaining a discrepancy between the actual wearing position and a prescribed desired wearing position; and outputting an instruction to the hearing device wearer to adjust a length of the receiver connector on a basis of the ascertained discrepancy between the actual wearing position and the desired wearing position.

The method according to the invention is used for physically adjusting a hearing device to suit a hearing device wearer. The hearing device (used for the method according to the invention) comprises a hearing device body and (particularly for the transmission of output signals to an auditory canal of the hearing device wearer) a receiver connecting means couplable or coupled to the hearing device body. To physically adjust the hearing device, the method involves a position sensor of the hearing device being used to ascertain a characteristic measure of a current actual wearing position of the hearing device. The characteristic measure of the actual wearing position is then taken as a basis for ascertaining a discrepancy between the actual wearing position and a prescribed (preferably in a factory) desired wearing position. An instruction is then output (preferably on the basis of the ascertained discrepancy) to the hearing device wearer to adjust the receiver connecting means on the basis of the ascertained discrepancy (i.e. the discrepancy between the actual wearing position and the desired wearing position).

This instruction to adjust the receiver connecting means, or receiver connector, is directed toward adjusting the length of the receiver connecting means to suit the ascertained discrepancy such that the discrepancy between the actual wearing position and the desired wearing position is reduced.

Preferably, particularly the actual wearing position of the hearing device body is ascertained and the discrepancy thereof from the desired wearing position of the hearing device body is determined.

Here and below, "characteristic" means particularly that the characteristic measure of the actual wearing position includes a (preferably quantitative) piece of information about the current actual wearing position, so that the actual wearing position can be explicitly read from this measure. By way of example, the characteristic measure indicates the current actual wearing position directly in this case. Alternatively, the characteristic measure is a variable that is directly or indirectly proportional to the actual wearing position. In addition, by way of example, the characteristic measure has a nonlinear, for example a logarithmic, exponential or polynomial (that is to say square, cubic, etc.) relationship with the actual wearing position.

Preferably, the (actual or desired) wearing position is defined particularly by an orientation of the hearing device in space. This orientation is in turn described preferably by at least one angle referred to as the "pitch angle". In this case, the pitch angle represents particularly an inclination of the hearing device about a horizontal axis running approximately transversely through the head of the hearing device wearer (i.e. from ear to ear). The wearing position is optionally additionally also described by inclinations of the hearing device (or of the hearing device body) about an axis of rotation (for example also relevant to a rotation of the head) that is frontal to the face of the hearing device wearer ("frontal axis") and/or runs vertically.

Here and below, "physical adjustment" is understood to mean particularly a structural adjustment of the hearing device to suit the anatomy of the hearing device wearer. This includes—optionally besides individual adjustment of an earmold to be worn in the auditory canal—particularly the selection of a receiver connecting means having a length suitable for the shape and size of the auricle of the hearing device wearer. This physical adjustment therefore differs from the adjustment to suit the individual hearing loss of the hearing device wearer, which usually likewise needs to be performed for a new hearing device and which is directed toward individual adjustment ("parameterization") of a signal processing unit (also referred to as a "signal processor") associated with the hearing device.

Preferably, the discrepancy between the actual wearing position and the desired wearing position is ascertained in an adjustment mode of the hearing device and preferably on the assumption that the hearing device wearer looks along the horizontal without holding his head askew. Preferably, at the beginning of the adjustment mode, an applicable instruction is output to the hearing device wearer (for example to keep his head still and to look horizontally or "straight ahead", preferably to look into his own eyes in a vertically oriented mirror).

The invention is based on the concept that the respective wearing position of the hearing device (i.e. the orientation thereof) correlates—depending on the arrangement of the position sensor in relation to at least two microphones associated with the hearing device—directly or indirectly with the spatial orientation of an effective spacing of the microphones in relation to one another (this orientation is also referred to as the "microphone axis")—or that they are related to one another in the factory (e.g. by referencing the output of the position sensor). In other words, the orientation of the microphone axis can be determined if the actual wearing position is known. Preferably, in a directivity mode of the hearing device, the microphone axis further also prescribes the preferred direction of the directivity of the hearing device. This preferred direction is in this case stipulated particularly in the factory, particularly to the effect that the preferred direction runs in a horizontal plane. If the receiver connecting means arranged on the hearing device body is too long or too short for the individual ear shape of the hearing device wearer, then the hearing device body—carrying the microphones—is therefore (particularly as a result of a certain stiffness of the receiver connecting means) shifted from its desired wearing position and, in so being, particularly tilted, so that the actual orientation of the microphone axis and hence the directivity differ from the preferred direction (particularly with regard to the head of the hearing device wearer) of the directivity that was intended in the factory. As a result of the actual wearing position being ascertained with sensor assistance, it is now advantageously possible to ascertain particularly precisely whether the hearing device or the hearing device body is arranged in the desired wearing position, and hence whether the receiver connecting means has a suitable length. In particular, the instruction to adjust the receiver connecting means as appropriate on the basis of the ascertained discrepancy can therefore reduce the discrepancy between the actual wearing position and the desired wearing position (preferably minimize it to a negligible extent) or even eliminate it completely.

Furthermore, the sensor-assisted (in particular, automatic) determination of the discrepancy between the actual and desired wearing positions and the instruction based thereon can simplify the physical adjustment of the hearing device particularly for inexperienced and/or unassisted hearing device wearers. Advantageously, it is therefore possible for even hearing device wearers who get their hearing device online, for example, i.e. particularly not via a sales channel with specifically trained personnel (e.g. via a hearing device acoustician), to easily achieve a satisfactory result for the physical adjustment of their hearing device. In addition, the method is also advantageous for adjustment of the hearing device by a hearing device acoustician, since the latter does not have to rely exclusively on his eye to orient the hearing device as intended and/or experimental effort can be saved.

Advantageously, the alignment of the actual wearing position with the desired wearing position therefore particularly allows a high level of speech intelligibility, and additionally also a high level of wearing comfort for the hearing device wearer. Consequently, the method according to the invention advantageously increases the use comfort of the hearing device.

In a preferred mode of the method, the microphone axis is stipulated in the factory (for example physically or by a directional parameter stored in a memory unit of the hearing device), preferably such that the hearing device arranged in the desired wearing position has the microphone axis and hence particularly also the preferred direction of the directivity oriented parallel to a frontal direction that is normal to the facial plane of the hearing device wearer. With a normal, neutral head posture, these are therefore also oriented parallel to the horizontal (i.e. in a horizontal plane). The effect achieved thereby is that the preferred direction of the directivity coincides with the direction for which the hearing device wearer orients his face transversely, i.e. along which the hearing device wearer orients his gaze (and particularly his head posture).

Preferably, the hearing device is a "behind the ear" (BTE for short) hearing device, the hearing device body of which is worn on the outside of (particularly behind) the auricle. In this case, the receiver connecting means leads from the hearing device body to the auditory canal or to the earmold that needs to be pushed into the auditory canal as intended.

The instruction to adjust the receiver connecting means is directed, as described above, at the adjustment of the length of the receiver connecting means to suit the discrepancy between the actual wearing position and the desired wearing position. Here and below, adjustment of the receiver connecting means is understood to mean particularly both the adjustment of the length of one and the same receiver connecting means and the selection of a receiver connecting means having a (in particular firmly) prescribed length from multiple receiver connecting means of different length, each of the same type.

In a particularly preferred development of the method described above, preferably a plurality of receiver connecting means (of the same type but) each having a different length are kept for the hearing device. The instruction for adjustment that is output is in this case preferably directed toward taking the ascertained discrepancy (between the actual wearing position and the desired wearing position) as a basis for coupling a receiver connecting means that has a shorter or longer length in comparison with the receiver connecting means currently arranged on the hearing device to the hearing device body (and if need be to the earmold). That is to say that the instruction is directed toward selection of a (particularly on the basis of the ascertained discrepancy) shorter or longer receiver connecting means. Therefore, in this case, the receiver connecting means is adjusted by selecting a longer or shorter receiver connecting means and by fitting it on the hearing device body and if need be on the earmold.

Preferably, particularly in the above case, the instruction that is output for adjusting the receiver connecting means on the basis of the ascertained discrepancy is a qualitative statement regarding the length of the receiver connecting means, such as e.g. "Please use a shorter receiver connecting means". In this case, the hearing device is delivered to the hearing device wearer as part of the hearing device system particularly with at least three receiver connecting means of different length, the receiver connecting means with the "middle" length preferably being pre-installed. Optionally, the receiver connecting means of different length have a marking (e.g. "1", "2", "3", etc.), the qualitative statement being directed toward this marking (e.g. "Please use receiver connecting means 3."). The qualitative instruction regarding the choice of length of the receiver connecting means can therefore be implemented particularly easily by the hearing device wearer.

Optionally, in the above case, the discrepancy between the actual wearing position and the desired wearing position is also ascertained qualitatively from the characteristic measure of the actual wearing position. That is to say that, in particular, it is ascertained whether the actual wearing position differs from the desired wearing position in a positive or negative direction (particularly with regard to a "neutral position" prescribed by the desired wearing position). A "positive" or "negative" discrepancy in this case has an associated longer or shorter length of the receiver connecting means (in comparison with the fitted length), preferably in a prescribed manner. By way of example, for a positive discrepancy, a table stores that a shorter length needs to be used, and vice versa.

Additionally or alternatively, the characteristic measure of the actual wearing position is taken as a basis for quantitatively ascertaining the discrepancy between the actual wearing position and the desired wearing position. In this case, the quantitatively ascertained value of the discrepancy is expediently compared with a limit value and an instruction to adjust the receiver connecting means is not output for comparatively small discrepancies (i.e. when the value does not exceed the limit value).

In the case of quantitative determination of the discrepancy, an optional variant of the method involves the ascertained discrepancy being taken as a basis for deriving a (quantitative) length difference between the fitted receiver connecting means and the receiver connecting means that is to be chosen. In this context, the instruction is directed toward the fitting of a "5 mm shorter" receiver connector, for example.

In a further alternative embodiment of the method that is fundamentally conceivable within the context of the invention—particularly if the receiver connector is used for audible sound transmission and hence comprises no electrical lines—the adjustment of the receiver connector is brought about by the hearing device wearer themselves (or if need be the hearing device acoustician) by virtue of the receiver connecting means being "cut to length" (i.e. "cut to size"). In an alternative variant, the receiver connecting means is designed to be of adjustable length, preferably telescopic, so that it is possible both to shorten and to lengthen the receiver connecting means. Particularly in these two variants, the quantitative length difference to be applied to the receiver connecting means is determined.

In a preferred embodiment of the method, the (or if need be the respective) instruction is output to the hearing device wearer audibly. Alternatively or additionally, the instruction is output visually on a control unit that is separate from the hearing device body—for example a smartphone with installed control software.

In a particularly expedient embodiment of the method, the position sensor used is an (in particular linear) acceleration sensor. This acceleration sensor is in this case preferably sensitive to the earth's gravitational field, so that the characteristic measure of the actual wearing position can be determined absolutely (i.e. particularly with regard to a coordinate system that is firmly prescribed, preferably fixed, externally to the hearing device). The knowledge of the desired wearing position in relation to the head or the ear of the hearing device wearer that is required for ascertaining the discrepancy (and if need be the length difference of the receiver connecting means) is in this case derived from the orientation of the hearing device ascertained with regard to the earth's gravitational field, preferably on the assumption that the hearing device wearer holds his head in a "normal" orientation (i.e. preferably, in accordance with the instruction described above, looking straight ahead along the horizontal). Therefore, the coordinate system of the head of the hearing device wearer is normalized to the coordinate system of the earth's gravitational field. Expediently, the ascertained characteristic measure of the actual wearing position is subsequently compared with an applicable measure of the desired wearing position in order to ascertain the discrepancy between the actual wearing position and the desired wearing position.

In an optional embodiment, the acceleration sensor is of multiaxis design and/or comprises multiple single sensors. Preferably, the acceleration sensor is moreover of MEMS-type design (i.e. in the form of a microelectro-mechanical system).

In an alternative embodiment of the method, the position sensor used is a magnetic field sensor. This is preferably set up to determine the characteristic measure of the actual wearing position absolutely, particularly with regard to the earth's magnetic field. Expediently, in this case too, the characteristic measure of the actual wearing position is compared with the applicable measure of the desired wearing position.

In an expedient embodiment of the method, the characteristic measure used for the current actual wearing position is an inclination of the hearing device body, particularly an angle of inclination (preferably the pitch angle) relative to the earth's gravitational field or relative to the horizontal. This inclination in turn correlates with the inclination of the microphone axis of the hearing device. Therefore, it is a simple matter for the discrepancy ascertained to be particularly the angle difference between the actual wearing position and the desired wearing position, particularly the (qualitative or quantitative) angle difference between the microphone axis and the frontal direction.

In a preferred embodiment of the method, the length to be chosen for the receiver connecting means (both for the case of a qualitative determination and for the case of a quantitative determination) is read particularly from a reference curve stored in the hearing device and preferably ascertained empirically. In this case, the term "reference curve" is understood here and below to mean both that a value of the length difference, which value is associated with a respective value of the ascertained discrepancy, is plotted in a graph and can be read therefrom and that the values associated with one another are listed in tabular form and hence are readable (for example in the style of a "look-up" table). The values associated with one another have in any case been ascertained on the basis of statistical series of experiments with a multiplicity of different hearing device wearers, so that the respective values are approximated, particularly by forming a mean value for an average ear shape (particularly a size of the auricle).

In a further preferred embodiment of the method, the hearing device wearer is particularly instructed to perform the method steps for ascertaining the discrepancy between the actual wearing position and the desired wearing position repeatedly, for example three to five times. In this case, the respective results of the ascertained discrepancy are preferably averaged and subsequently the averaged discrepancy is taken as a basis for outputting the instruction to adjust the receiver connecting means. Preferably, the hearing device wearer is in this case instructed to put on the hearing device again before each ascertainment of the discrepancy. As a result, it is possible to reduce effects of errors by the hearing device wearer when putting on the hearing device that influence the actual wearing position and are not related to the length of the currently coupled receiver connecting means.

Alternatively or additionally, it is also conceivable within the context of the invention for the method steps described above to be repeated in their entirety (i.e. for the receiver connecting means to be changed repeatedly if need be) and hence for the actual wearing position to be iteratively aligned with the desired wearing position if need be, particularly until the actual wearing position corresponds to the desired wearing position or there is a drop below a prescribed limit value for the discrepancy—below which the influence of the discrepancy on the directivity is advantageously negligible.

In a further, alternative embodiment of the method that is conceivable within the context of the invention, particularly the length difference for the receiver connecting means is ascertained, specifically preferably on the assumption that the auricle approximately describes a circular path at least in the region on which the hearing device body rests as intended. Along this circular path, the hearing device therefore shifts forward and backward on the basis of the length of the receiver connecting means. From an empirically ascertained average value for the radius of this circular path, it is therefore possible, given knowledge of the angle difference between the desired and actual wearing positions, to approximately infer the length difference (particularly using calculation rules for triangles, in particular isosceles triangles).

In an expedient embodiment of the method, adjustment of the receiver connecting means is followed by the actual wearing position of the hearing device (or of the hearing device body) on the head of the hearing device wearer being determined again (particularly for checking purposes). If no discrepancy from the desired wearing position is found (or the described limit value is not exceeded), then the adjustment mode is terminated and the hearing device changes to a normal mode of operation.

With the above and other objects in view there is also provided, in accordance with the invention, a hearing device, comprising:

a hearing device body housing at least two microphones, a position sensor and a control unit;

a loudspeaker;

a receiver connector coupled or couplable to said hearing device body for transmitting output signals to an auditory canal of a hearing device wearer;

the control unit is configured to carry out the method as described above.

There is also provided, in accordance with the invention, a hearing device system, which comprises a hearing device as summarized above and a plurality of receiver connectors having mutually different lengths.

In other words, the hearing device according to the invention comprises the hearing device body, in which the microphones, a position sensor and a control unit are arranged. The control unit is in this case set up to perform the method described above. Furthermore, the hearing device comprises a loudspeaker. For the transmission of output signals to the auditory canal of the hearing device wearer, the hearing device body is moreover couplable or coupled (preferably reversibly) to the (particularly the respective) receiver connecting means.

Preferably, the hearing device also comprises an earmold that is couplable or coupled (in particular reversibly) to the hearing device body by means of the receiver connecting means for the purpose of operation of the hearing device.

In a preferred refinement, the control unit is at least in essence formed by a microcontroller having a processor and particularly having a data memory, in which the functionality for performing the method according to the invention is implemented by programming in the form of a piece of operating software (firmware), so that the method—if need be in interaction with the hearing device wearer—is performed automatically when the operating software is executed in the microcontroller. The control unit may, within the context of the invention, alternatively also be formed by a non-programmable electronic component, e.g. an ASIC, however, in which the functionality for performing the method according to the invention is implemented using circuitry means.

In a preferred embodiment, the receiver connecting means is not in the form of part of the hearing device, but is necessary for operation of the hearing device as intended. That is to say that during operation of the hearing device as intended, the receiver connecting means is coupled to the hearing device and if need be to the ear mold.

In an alternative embodiment that is conceivable within the context of the invention, the receiver connecting means is in the form of part of the hearing device and is of adjustable length. In particular, the receiver connecting means is telescopic between discrete length settings in this case.

In a preferred embodiment, the position sensor is particularly the acceleration sensor described above.

The hearing device system according to the invention comprises the hearing device of the type described above—particularly the hearing device in which the receiver connecting means is not of adjustable length and is not part of the hearing device. In this case, the hearing device system comprises a plurality of receiver connecting means (i.e. at least two, preferably at least three) that each have a different length. In this case, the hearing device system is particularly a sales unit that is accompanied by multiple receiver connecting means of different length for the purpose of simple individual, physical adjustment using the method described above.

Particularly if the hearing device has a loudspeaker installed in the hearing device body for the purpose of outputting audible signals, the respective receiver connecting means is a sound tube in an expedient embodiment. In an alternative embodiment, particularly if the hearing device is in the form of what is known as an RIC ("receiver in canal") hearing device, and therefore the loudspeaker is arranged outside the hearing device body and in the earmold for placement in the auditory canal, the respective receiver connecting means is a receiver cable that is set up for electronically transmitting the output signals to the loudspeaker.

Other features which are considered as characteristic for the invention are set forth in the appended claims.

Although the invention is illustrated and described herein as embodied in a method for physically adjusting a hearing device, hearing device and hearing device system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

Mutually corresponding parts and dimensions are provided with the same reference symbols throughout all the figures.

DETAILED DESCRIPTION OF THE INVENTION

Figure 1:
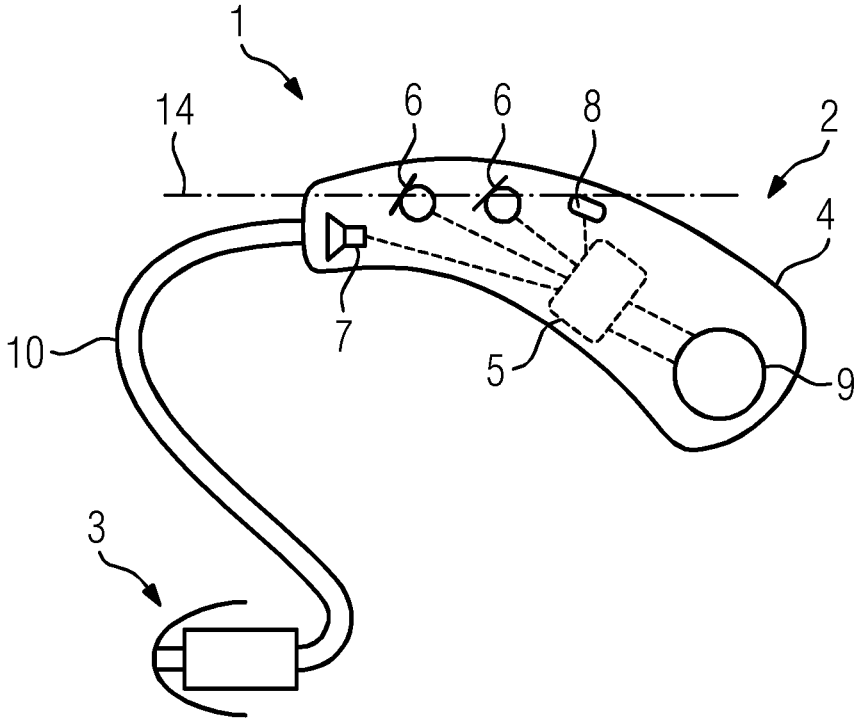
FIG. 1 shows a schematic side view of a hearing device having a hearing device body, a receiver connecting means and an earmold.

Referring now to the figures of the drawing in detail and first, particularly, to FIG. 1 thereof, there is shown a hearing device 1. The hearing device 1 comprises a hearing device body 2 that carries multiple electronic components of the hearing device 1, and also an earmold 3 that is set up and provided for insertion into an auditory canal of a hearing device wearer. The hearing device body 2 has a housing 4 inside which a processor unit (referred to as processor 5 for short), two microphones 6 and a loudspeaker 7 are arranged as components of the hearing device 1. In this case, the processor 5 has a signal processor for processing the input signals captured by the microphones 6 and a control processor (or: a control unit) integrated in it. The latter is set up and provided for interaction with the hearing device wearer (for example for the purpose of selecting different hearing programs, volume control etc.). As a further component, a position sensor 8, specifically an acceleration sensor that is sensitive to the earth's gravitational field, is arranged on the hearing device body 2. The components are interconnected with the processor 5 by means of respective associated signal lines. For supplying power to the components, the hearing device 1 has a battery unit 9. The battery unit 9 is in this case specifically in the form of a rechargeable battery with associated charging electronics.

During operation, the earmold 3 is coupled to the hearing device body 2, specifically to a sound output of the loudspeaker 7, via a receiver connecting means, or receiver connector, which, in the present example, is formed by a sound tube 10. During operation, the sound tube 10 transmits the sound signals output by the loudspeaker 7 to the eardrum of the hearing device wearer audibly via the earmold 3.

In an alternative exemplary embodiment, which is not depicted in more detail, the loudspeaker 7 has been relocated from the hearing device body 2 and is arranged in the earmold 3. In this case, the receiver connector is formed by a receiver cable.

Figure 2:
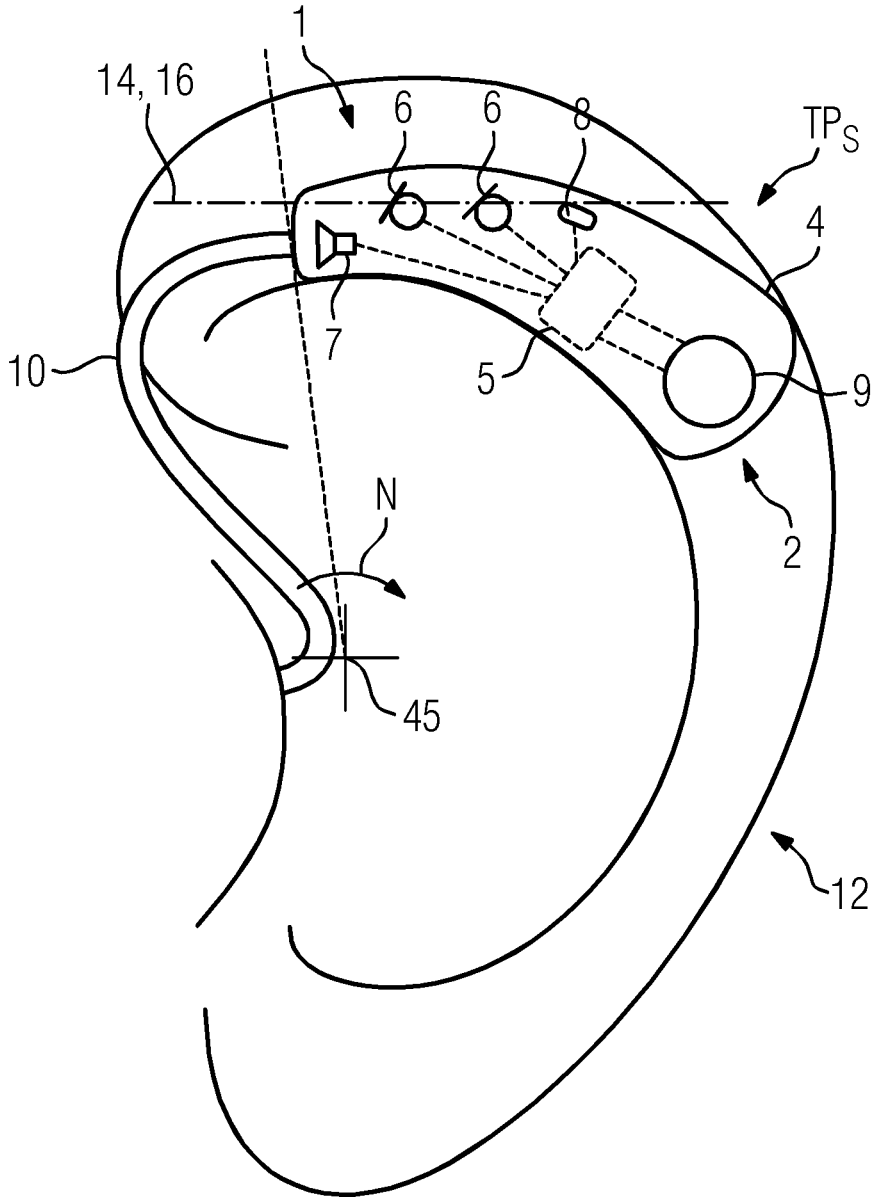
FIG. 2 shows the hearing device in a desired wearing position as intended on the ear of a hearing device wearer in a view according to FIG. 1.

During the operation of the hearing device 1, the input signals that are output by the two microphones 6 (on reception of ambient sound) are mixed with one another in a directivity mode such that a direction-dependent sensitivity arises for the captured ambient sound. That is to say that the microphones 6 capture sound components from different spatial directions at different intensity. In a basic setting, the preferred spatial direction, i.e. the direction from which sound arriving is captured at the highest intensity (also referred to as the preferred direction), is oriented along a horizontal plane—provided that the hearing device 1 is worn in a position as intended (subsequently referred to as the desired wearing position $TP_S$) behind the ear, specifically on the auricle 12, and the head is kept straight at the same time (cf. FIG. 2). In the present exemplary embodiment, the microphones 6 are arranged in succession along a microphone axis 14. When the hearing device 1 is arranged in the desired wearing position $TP_S$, this microphone axis 14 coincides with the horizontal plane and a direction oriented frontally with respect to the face of the hearing device wearer ("frontal direction 16") (see FIG. 2). As a result, in directivity mode, the sound components that arrive at the microphones 6 from this frontal direction 16 are captured in boosted fashion in comparison with sound components arriving from the side. This is advantageous on the assumption that the hearing device wearer usually has his front facing an interlocutor. The preset directivity described therefore allows a particularly high level of speech intelligibility. It is recognized that the directivity is not fixed in terms of location, but rather is firmly prescribed relative to the head of the hearing device wearer. That is to say that when the head turns, the preferred direction of the microphones 6 also moves with it accordingly. Therefore, the preferred direction and hence the highest speech intelligibility are always oriented parallel to the orientation of the head of the hearing device wearer (approximated by a "normal" perpendicular to the "facial plane").

Figure 3:
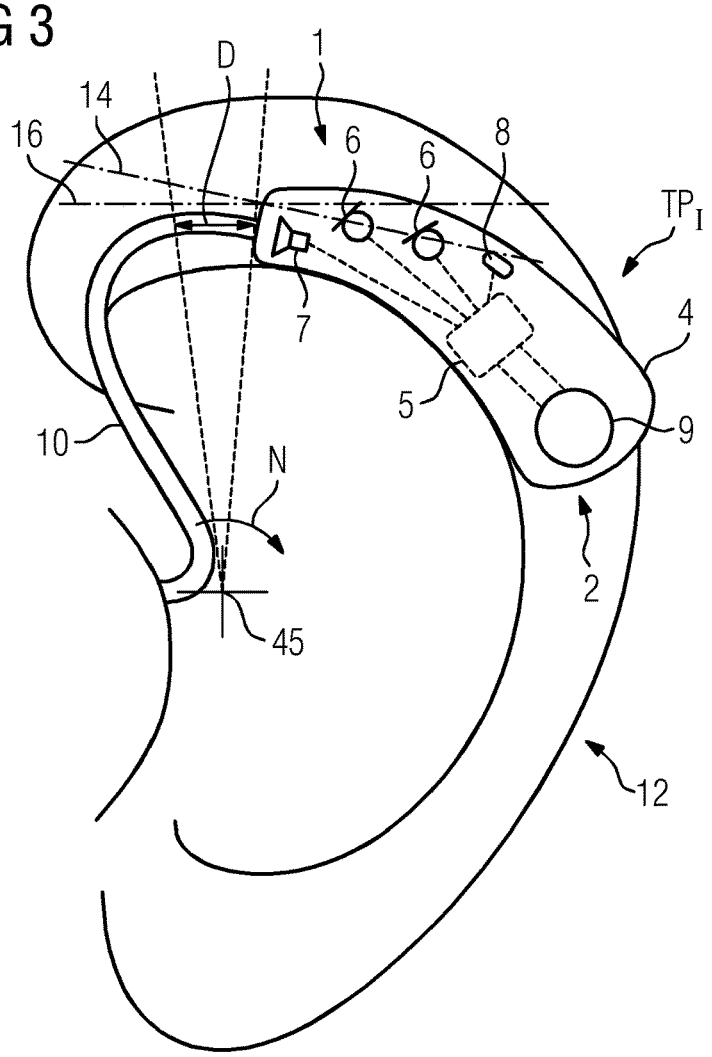
FIG. 3 shows the hearing device in an actual wearing position in a view according to FIG. 2.

Since the shape and size of the auricle 12 is individual in each hearing device wearer, the length of the sound tube 10 means that it is possible, however, for the hearing device body 2 to be shifted relative to its desired wearing position $TP_S$. As a result, the microphone axis 14 and the frontal direction 16 no longer coincide (cf. FIG. 3) and speech intelligibility in the directivity mode falls. To individually adjust the hearing device 1 to suit the hearing device wearer, the hearing device 1 is therefore accompanied, as part of the hearing device system, by multiple sound tubes 10 of different length (not depicted in more detail). In this case, the hearing device system forms a sales unit for the hearing device 1.

Figure 4:
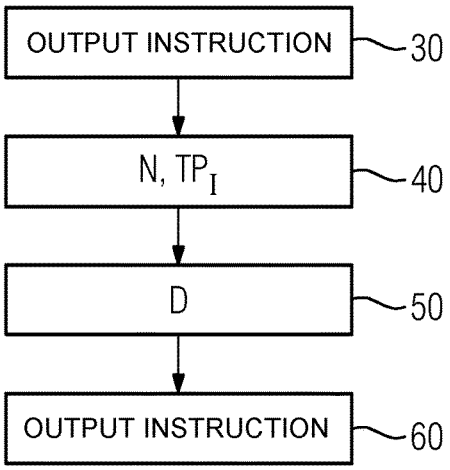
FIG. 4 shows a schematic flowchart for a method for physically adjusting the hearing device to suit the ear of the hearing device wearer.

To allow even a hearing device wearer who does not get the hearing device 1 from a specifically trained hearing device acoustician or technician to nevertheless obtain individual, precise adjustment to suit his ear shape, the processor 5 stores a method sequence (depicted schematically in FIG. 4) for an adjustment mode. This is started when the hearing device 1 first starts (or optionally upon an input from the hearing device wearer).

In a first method step 30, the hearing device 1 gives the hearing device wearer, via the loudspeaker 7, the instruction to keep his head straight and look straight ahead along the horizontal (for example look himself in the eye in the mirror) with the hearing device 1 donned, so that the frontal direction 16 coincides with a horizontal plane. In a second method step 40, the position sensor 8 is used to ascertain a characteristic measure of a current actual wearing position $TP_I$ (cf. FIG. 3). This characteristic measure is an angle of inclination about a "pitch axis" 45 (running horizontally and from ear to ear). This angle of inclination ("pitch angle N" for short) is ascertained with regard to the earth's gravitational field in this case. A comparison with a pitch angle N applicable to the desired wearing position $TP_S$ is subsequently used to ascertain a discrepancy, specifically an angle difference, between the actual wearing position $TP_I$ and the desired wearing position $TP_S$ of the hearing device 1.

In an optional exemplary embodiment, method steps 30 and 40 are repeated multiple times and the angle difference is averaged over all repetitions in this case.

The (optionally averaged) angle difference is used in a subsequent method step 50 to ascertain whether the sound tube 10 is too long or too short. This ascertainment is effected on the basis of a table from which the processor 5 reads whether (the value of) the ascertained angle difference has an associated longer or shorter sound tube 10.

Subsequently, in a method step 60, the loudspeaker 7 is used to output an instruction to the hearing device wearer to couple a longer or shorter sound tube 10, according to the discrepancy, to the hearing device body 2 and the earmold 3 and then to put on the hearing device 1 again. Subsequently, the sound tube 10 is checked by repeating method steps 30 and 40 before the hearing device 1 changes to a normal mode of operation.

In an alternative exemplary embodiment (likewise depicted in FIG. 4), this angle difference is used to ascertain a length difference D for the sound tube 10 in method step 50. The value of the length difference D associated with the value of the ascertained angle difference is in this case stored in a table that has been set up on the basis of empirical examinations on a multiplicity of test subjects and stored in the processor 5. The length difference D is in this case chosen such that when a correspondingly longer or shorter sound tube 10 is coupled to the hearing device body 2 and the earmold 3, said length difference leads to a reduction in the angle difference between the actual wearing position $TP_I$ and the desired wearing position $TP_S$, and hence the microphone axis 14 is brought closer to the frontal direction 16.

Subsequently, in method step 60, the loudspeaker 7 is used to "voice" an instruction to the hearing device wearer to couple a longer or shorter sound tube 10, according to the length difference D, to the hearing device body 2 and the earmold 3 and then to put on the hearing device 1 again.

In all the exemplary embodiments described above, it is possible for method steps 30 to 60 to be repeated until the angle difference between the actual wearing position $TP_I$ and the desired wearing position $TP_S$ is negligibly small and/or has dropped below a prescribed limit value. The hearing device 1 then changes to a normal mode of operation.

Provided that the ascertained angle difference does not exceed a prescribed limit value, an instruction is not output to the hearing device wearer and the hearing device 1 changes to the normal mode of operation.

The subject matter of the invention is not limited to the exemplary embodiment described above. Rather, further embodiments of the invention can be derived from the description above by a person skilled in the art.

The following is a summary list of reference numerals and the corresponding structure used in the above description of the invention:

1 Hearing device
2 Hearing device body
3 Earmold
4 Housing
5 Processor
6 Microphone
7 Loudspeaker
8 Position sensor
9 Battery unit
10 Sound tube
12 Auricle
14 Microphone axis
16 Frontal direction
30 Method step
40 Method step
45 Pitch axis
50 Method step
60 Method step
$TP_S$ Desired wearing position
$TP_I$ Actual wearing position
N Pitch angle
D Length difference

The invention claimed is:

1. A method for physically adjusting a hearing device to suit a hearing device wearer, wherein the hearing device has a hearing device body and a receiver connector couplable or coupled to the hearing device body, the method comprising:
- using a position sensor of the hearing device to ascertain a characteristic measure of a current actual wearing position of the hearing device;
- taking the characteristic measure of the actual wearing position as a basis for ascertaining a discrepancy between the actual wearing position and a prescribed desired wearing position;
- reading a selectable length of the receiver connector from a reference curve stored in the hearing device; and
- outputting an instruction to the hearing device wearer to adjust a length of the receiver connector on a basis of the ascertained discrepancy between the actual wearing position and the desired wearing position.

2. The method according to claim 1, wherein the position sensor is an acceleration sensor.

3. The method according to claim 1, wherein the characteristic measure used for the current actual wearing position is an inclination of the hearing device body.

4. The method according to claim 1, wherein the desired wearing position is stored with a microphone axis connecting at least two microphones of the hearing device that forms a basis for directivity oriented along a horizontal plane.

5. A hearing device, comprising:
- a hearing device body housing at least two microphones, a position sensor and a control unit configured to carry out the method according to claim 1;
- a loudspeaker;
- a receiver connector coupled or couplable to said hearing device body for transmitting output signals to an auditory canal of a hearing device wearer.

6. The hearing device according to claim 5, wherein said position sensor is an acceleration sensor.

7. A hearing device system, comprising:
- a hearing device according to claim 5; and
- a plurality of receiver connectors having mutually different lengths.

8. The hearing device system according to claim 7, wherein said receiver connectors are sound tubes or receiver cables.

9. A method for physically adjusting a hearing device to suit a hearing device wearer, wherein the hearing device has a hearing device body and a receiver connector couplable or coupled to the hearing device body, the method comprising:
- providing a plurality of receiver connectors having mutually different lengths;
- using a position sensor of the hearing device to ascertain a characteristic measure of a current actual wearing position of the hearing device;
- taking the characteristic measure of the actual wearing position as a basis for ascertaining a discrepancy between the actual wearing position and a prescribed desired wearing position;
- reading a selectable length of the receiver connector from a reference curve stored in the hearing device;
- outputting an instruction to the hearing device wearer to adjust a length of the receiver connector on a basis of the ascertained discrepancy between the actual wearing position and the desired wearing position, and directing the instruction toward taking the ascertained discrepancy as a basis for coupling a receiver connector that has a shorter or longer length in comparison with the receiver connector that is currently connected to the hearing device body.

10. The method according to claim 9, wherein the position sensor is an acceleration sensor.

11. The method according to claim 9, wherein the characteristic measure used for the current actual wearing position is an inclination of the hearing device body.

12. The method according to claim 9, wherein the desired wearing position is stored with a microphone axis connecting at least two microphones of the hearing device that forms a basis for directivity oriented along a horizontal plane.

13. A hearing device system, comprising:
- a hearing device body housing at least two microphones, a position sensor and a control unit configured to carry out the method according to claim 9;
- a loudspeaker;
- a plurality of receiver connectors couplable to said hearing device body for transmitting output signals to an auditory canal of a hearing device wearer.

14. The hearing device system according to claim 13, wherein said position sensor is an acceleration sensor.

15. The hearing device system according to claim 13, wherein said receiver connectors are sound tubes or receiver cables.

* * * * *